US006919787B1

(12) United States Patent
Macken

(10) Patent No.: US 6,919,787 B1
(45) Date of Patent: Jul. 19, 2005

(54) METHOD AND APPARATUS FOR MAGNETIC COUPLING

(76) Inventor: John A. Macken, 233 Twin Pillar Way, Santa Rosa, CA (US) 95404

( * ) Notice: Subject to any disclaimer, the term of this patent is extended or adjusted under 35 U.S.C. 154(b) by 0 days.

(21) Appl. No.: 10/971,998

(22) Filed: Oct. 23, 2004

(51) Int. Cl.[7] ..... H01F 7/20

(52) U.S. Cl. ..... 335/285; 335/302; 335/306

(58) Field of Search ..... 335/285–306

(56) References Cited

U.S. PATENT DOCUMENTS 5,072,204 A * 12/1991 Leupold ..... 335/306

* cited by examiner

*Primary Examiner*—Ramon M. Barrera
(74) *Attorney, Agent, or Firm*—Craig M. Stainbrook; Larry D. Johnson; Johnson & Stainbrook, LLP

(57) ABSTRACT

The invention is a magnetic coupling device that utilizes a supported spherical magnet to attach to a hole in a ferromagnetic object. The hole shape and the orientation of the spherical magnet are predetermined to form a relatively strong magnetic attachment. The magnetic coupling device exhibits unique characteristics such as angular tolerance, precise positioning and controllable release characteristics.

23 Claims, 7 Drawing Sheets

METHOD AND APPARATUS FOR MAGNETIC COUPLING

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to magnetic couplers, attachment devices and fasteners, and more specifically to an improved magnetic coupling apparatus with desirable release characteristics, accurate positioning and angular flexibility.

BACKGROUND INFORMATION AND DISCUSSION OF RELATED ART

Magnets have long been used as a means for making a temporary connection between two components. However, when a magnet is attached to a ferromagnetic material, such as a piece of steel there are several characteristics which are undesirable for specific applications.

First, the release characteristics are undesirable when an ordinary magnet is attached to a ferromagnetic surface such as steel. It is about six times easier to slide the magnet sideways across the surface of a piece of steel than it is to remove the magnet by pulling perpendicular to the steel surface. In many applications it would be desirable to be able to control the release characteristics of a magnetic connection. For example, in applications requiring a known release for safety, it would be desirable to have the magnet release with the same force magnitude, no matter whether the force is applied parallel or perpendicular to the surface. In other locking applications, it may be desirable to have the magnet release easily when the force is applied in a predetermined direction, but hold much more firmly when the force is applied in other directions.

Second, ordinary magnets do not position themselves accurately when they attach to steel. In some applications it would be desirable for the magnet to always attach itself to a precise location on the steel.

Third, ordinary magnets usually mate flat against a steel surface in such a way that does not allow any angular adjustability. In some applications, it would be desirable, if the magnetic coupling had the characteristics of a ball joint, which permits some flexibility in the angle between a magnet and a piece of steel, while holding a precise translational position.

There are numerous patents relating to magnetic couplers, attachment devices or fasteners. However, none of them provide the above mentioned release characteristics, accurate positioning and angular flexibility.

For example, U.S. Pat. No. 5,993,212 discloses a ball joint with an internal magnet. However, the actual magnetic coupling made between the magnet and a release member is inflexible. Only the ball joint support holding the magnet gives the apparatus any angular flexibility. Furthermore, the apparatus is unduly complex.

The foregoing patent and background discussion reflects the current state of the art of which the present inventor is aware. Reference to, and discussion of, this information is intended to aid in discharging Applicant's acknowledged duty of candor in disclosing information that may be relevant to the examination of claims to the present invention. However, it is respectfully submitted that none of the above-indicated information discloses, teaches, suggests, shows, or otherwise renders obvious, either singly or when considered in combination, the invention described and claimed herein.

BRIEF SUMMARY OF THE INVENTION

The present invention discloses a magnetic coupling device with unique characteristics that make it suitable for a broad range of applications. The magnetic coupling device uses an adhered member (preferably non-magnetic) connected to a spherical magnet (preferably a rare earth magnet). The spherical magnet at least partially enters a hole in a release member to make a magnetic coupling, which effectively connects the release member to the adhered member.

The hole has an opening that can be used to define a plane. Also, the spherical magnet has a north pole, a south pole and a magnetic axis. When the spherical magnet makes a magnetic attachment to the release member, the magnetic axis of the spherical magnet is preferably oriented generally parallel to the plane of the hole opening. This orientation is unusual, because usually magnets are oriented with the magnetic axis perpendicular to a ferromagnetic surface.

The size and shape of the hole in the ferromagnetic material of the release member is predetermined to mate with the spherical magnet to achieve specific attachment characteristics. For example, a specific hole size or a hole with specific conical sides can achieve a magnetic attachment that will release with the same force magnitude no matter whether the force is applied perpendicular or parallel to the plane of the hole opening. This has potential uses in devices that, for safety reasons, must release at a predetermined force. Other elongated hole shapes can achieve unsymmetrical release characteristics where it is much easier to release the magnetic coupling with a force from a predetermined direction than with forces from other directions.

All holes, but especially holes with a hemispherical or conical shape, exhibit a precise positioning between the spherical magnet and the release member. Finally, the spherical shape of the magnet also gives the magnetic coupling device of the present invention the angular tolerance of a ball joint. This is a very useful characteristic because it accommodates an angular misalignment when the release member is being attached to the nonmagnetic adhered member using the intermediary of the spherical magnet.

It is therefore an object of the present invention to provide a new and improved method and apparatus for magnetic coupling.

It is another object of the present invention to provide a new and improved magnetic coupling device with desirable release characteristics.

A further object or feature of the present invention is a new and improved magnetic coupling device that permits accurate positioning.

An even further object of the present invention is to provide a novel magnetic coupling device with angular flexibility.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to give a brief and non-technical description of the invention. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
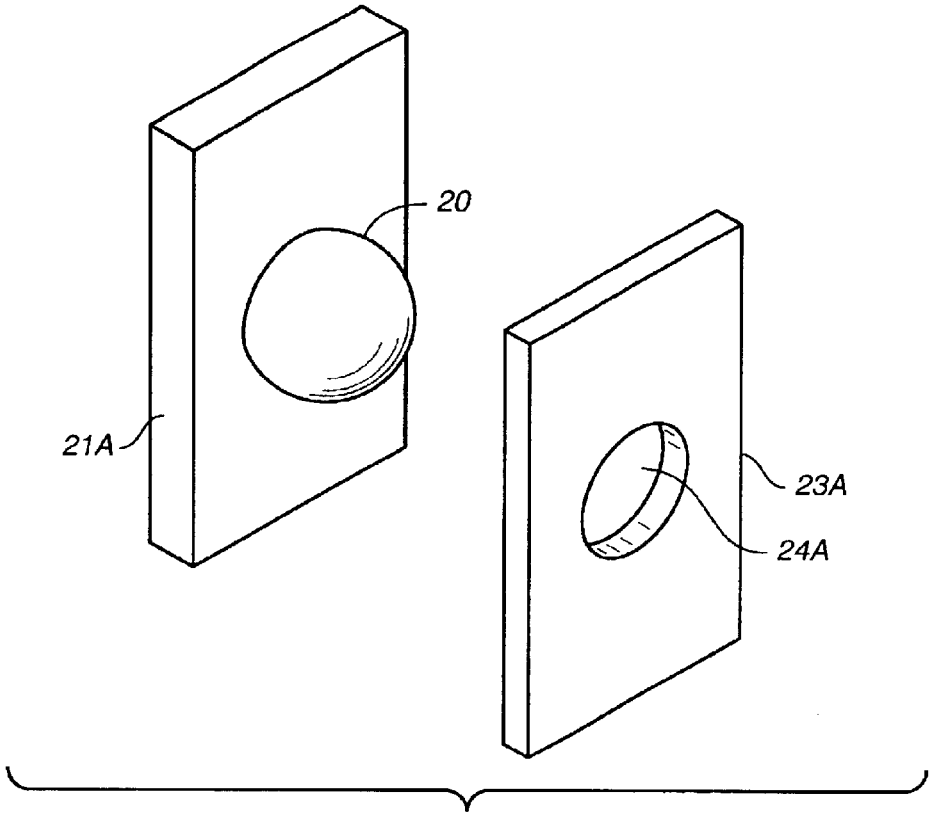
FIG. 1 is a perspective view of the simplest embodiment of the invention. It has a spherical magnet, an adhered member and a release member with a hole.

Referring to FIGS. 1 through 17, wherein like reference numerals refer to like components in the various views, there is illustrated therein a new and improved magnetic coupling device, generally denominated 10 herein.

The advent of high strength rare earth magnets has resulted in new shapes and new characteristics for permanent magnets. One of the new shapes is the spherical permanent magnet. Typically, the spherical rare earth magnets (particularly the NdFeB magnets) are magnetized so that they exhibit a "focused magnetic field". This is to say that inside the spherical magnet, the magnetic flux lines are not parallel. Instead, these lines tend to focus towards the North and South Poles of the magnet. The result of this magnetic focusing is that the spherical magnets can achieve a particularly strong magnetic field strength at the North Pole and South Pole of the spherical magnet. Experiments described here were made utilizing spherical rare earth magnets with focused magnetic fields. However, the teachings described herein will work with substantially spherical permanent magnets made of other materials or magnetized in an unfocused (parallel) magnetization pattern. Furthermore, it is not essential that the north and south poles be on precisely the opposite sides of the sphere.

FIG. 1 shows a spherical permanent magnet 20 adhered to a first member that will be called an "adhered member" 21 A. The shape of the adhered member 21A is unimportant. It is merely an object that is attached to a spherical magnet 20 by an adhesive or by any other attachment means such as mechanical crimping. It is preferable that at least a portion of the adhered member should be made of a nonmagnetic material. This will be explained in more detail later.

FIG. 1 also shows a second member 23A which contains a hole 24A. This second member, will be referred to as the "release member" 23A. The release member can also be any overall shape, only the size and shape of the hole is important. The hole size and shape must mate to the spherical magnet to achieve predetermined magnetic coupling characteristics. Also, at least a portion of the release member must be made of a ferromagnetic material such as iron, steel or nickel. This will be explained in detail later. For initial simplicity, we will assume that the entire adhered member 21A is non-magnetic and the entire release member 23A is ferromagnetic.

Figure 2:
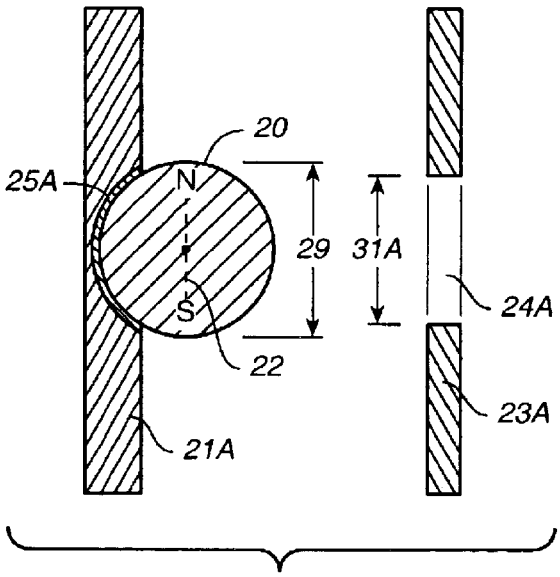
FIG. 2 is a cross sectional view of the device shown in FIG. 1.

FIG. 2 shows a cross-section view of the magnetic coupling device depicted in FIG. 1. The spherical magnet 20 is shown with a North Pole designated as "N" and a South Pole designated as "S". The dashed line 22 between the North and South Pole's will be referred to as the "magnetic axis" of the permanent magnet. Even if the spherical magnet has a focused magnetic field, the magnetic axis will be defined as the line connecting the strongest North Pole region on the surface of the spherical magnet to the strongest South magnetic pole region of the surface.

FIG. 2 also shows a cross-section of the adhered member 21A and the adhesive 25A. The release member 23A has a hole 24A designed to mate with the spherical magnet. In FIG. 2, the diameter of hole 24A is designated 31A and the diameter of the spherical magnet 20 is designated 29. In FIG. 2, hole diameter 31A is depicted as being slightly smaller than diameter 29 of the spherical magnet 20. This diameter could also be slightly larger than the sphere diameter 29. The exact size and shape of the hole 24A affects the attachment and release characteristics between the spherical magnet 20 and the release member 23A. Therefore, the size and shape of the hole is predetermined to mate with the spherical magnet and achieve desirable magnetic coupling characteristics. In general, it can be stated that if the hole is circular as depicted in FIG. 2, then to achieve the mating and magnetic qualities desired, the hole will have an entrance diameter 31A that is between 60% and 150% of the sphere diameter, 29. If the hole does not have a circular entrance (as will be discussed with reference to FIGS. 13 to 16), then the hole will still have at least a width dimension between 60% and 150% of the sphere diameter 29.

Figure 3:
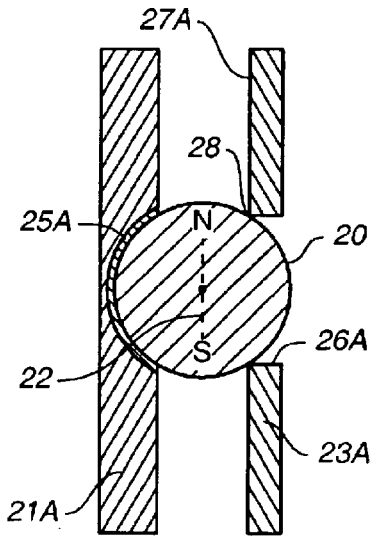
FIG. 3 is a cross-sectional view of the device in FIG. 1, except that the release member is shown mating to the spherical magnet.

FIG. 3 shows the ferromagnetic release member 23A contacting and magnetically coupled to spherical magnet 20, which is adhered to adhered member 21A by adhesive 25A. It should be noted that the hole 24A has sidewalls 26A, which are generally perpendicular to surface 27A. This type of hole is the easiest to form, but the contact 28 is at a sharp corner. Other hole contours will be described in subsequent figures. It should also be noted that the spherical magnet 20 has been attached to the adhered member 21A in such a way that the magnetic axis 22 will be roughly parallel to surface 27A of the release member 23A. More will be said about this point later.

Figure 4:
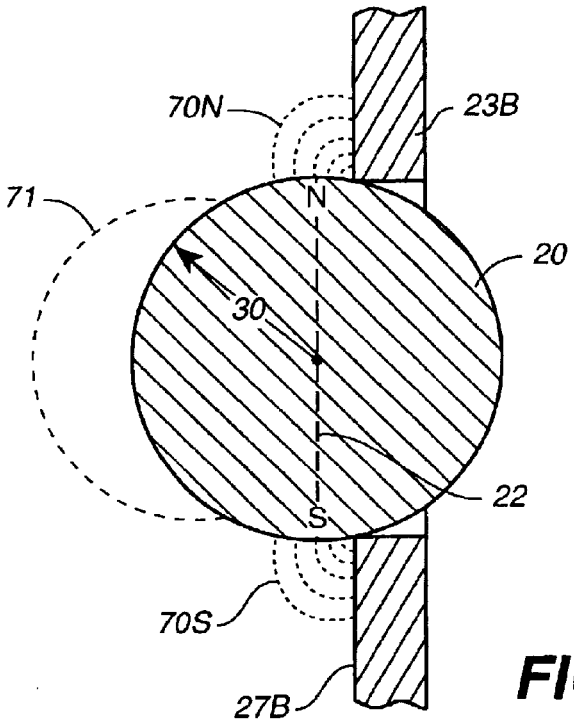
FIG. 4 is a cross sectional view of a portion of the device in FIG. 3, but with the addition of external magnetic flux lines.

FIG. 4 gives a closer view of a spherical magnet 20 and a release member. The purpose of FIG. 4 is to discuss the magnetic principles involved. For simplicity, FIG. 4 does not show any adhered member or adhesive. In FIG. 4, the magnetic flux lines 70N, 70S are depicted as emanating from the north magnetic pole (dashed lines 70N) and the south magnetic pole (dashed lines 70S). There are also some fringe flux lines 71.

In FIG. 4, it can be seen that most of the magnetic flux lines emanating from the north magnetic pole N enter the ferromagnetic release member 23B. Similarly, most of the magnetic flux lines also emerge from release member 23B and enter the south pole S of the spherical magnet 20. The release member 23B is illustrated in cross section in FIG. 4, but a perspective view would be similar to FIG. 1. Therefore, the magnetic flux lines are able to travel through the ferromagnetic release member 23B and around the hole 24B to complete the magnetic circuit. The magnetic flux lines illustrated in FIG. 4 are characteristic of a strong magnetic attraction between spherical magnet 20 and release member 23B. The strongest magnetic coupling force occurs when magnetic axis 22 is parallel to surface 27B. However, the magnetic axis 22 can be tipped considerably and still provide satisfactory coupling. This will be discussed further in reference to FIGS. 11 and 12.

If the diameter of the hole 31A in FIG. 2 is slightly larger than the diameter of the spherical magnet (29 in FIG. 2), but preferably less than 1.5 times the sphere diameter, then FIG. 4 would change. The larger hole in the ferromagnetic release member 23B would allow the release member to position itself directly over magnetic axis 22 (which would bisect release member 23B). This is an equilibrium position and magnetic forces oppose moving either the release member 23B or the magnet 20 away from this equilibrium position. This embodiment of the invention has a spring like quality because magnetic forces are somewhat elastic and the magnetic force attempts to restore the magnet and release member to the equilibrium position. In fact, the magnetic flux lines in FIG. 4 show what happens when a force is applied such that the relative position of the release member and the magnet is displaced from the equilibrium position. Another useful feature of this type of magnetic coupling is that it has a dampening quality. Any oscillations would lose energy because of magnetic hysteresis and electrical eddy currents.

It is possible to tailor this type of magnetic coupler to achieve a desired magnetic spring constant depending on the size and strength of the spherical magnet as well as the size, shape and thickness of the release member 23B. For example, if the thickness of release member 23B were made approximately equal to the diameter of the spherical magnet, then this would produce unusual elastic and dampening qualities.

Figure 5:
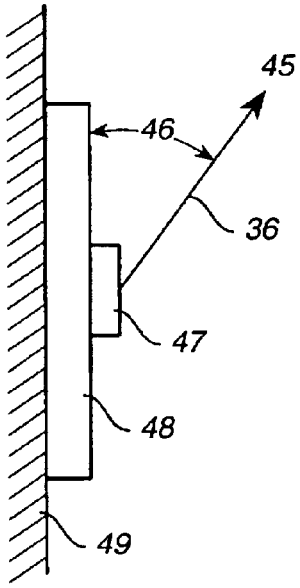
FIG. 5 is a cross sectional view of an ordinary disk magnet attached to a flat piece of steel.
Figure 6:
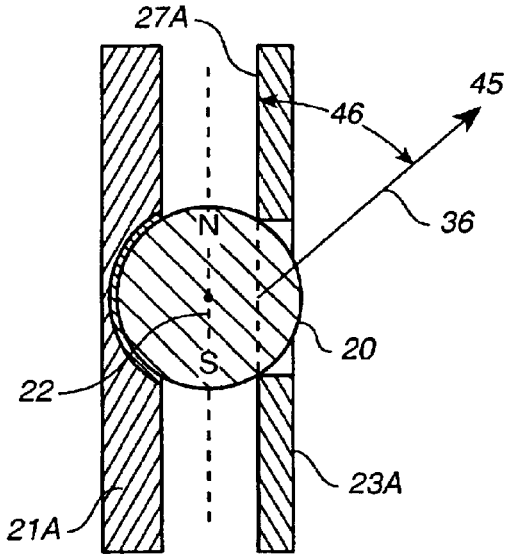
FIG. 6 is a cross sectional view of the device in FIG. 3, except with the addition of force vector designations.
Figure 7:
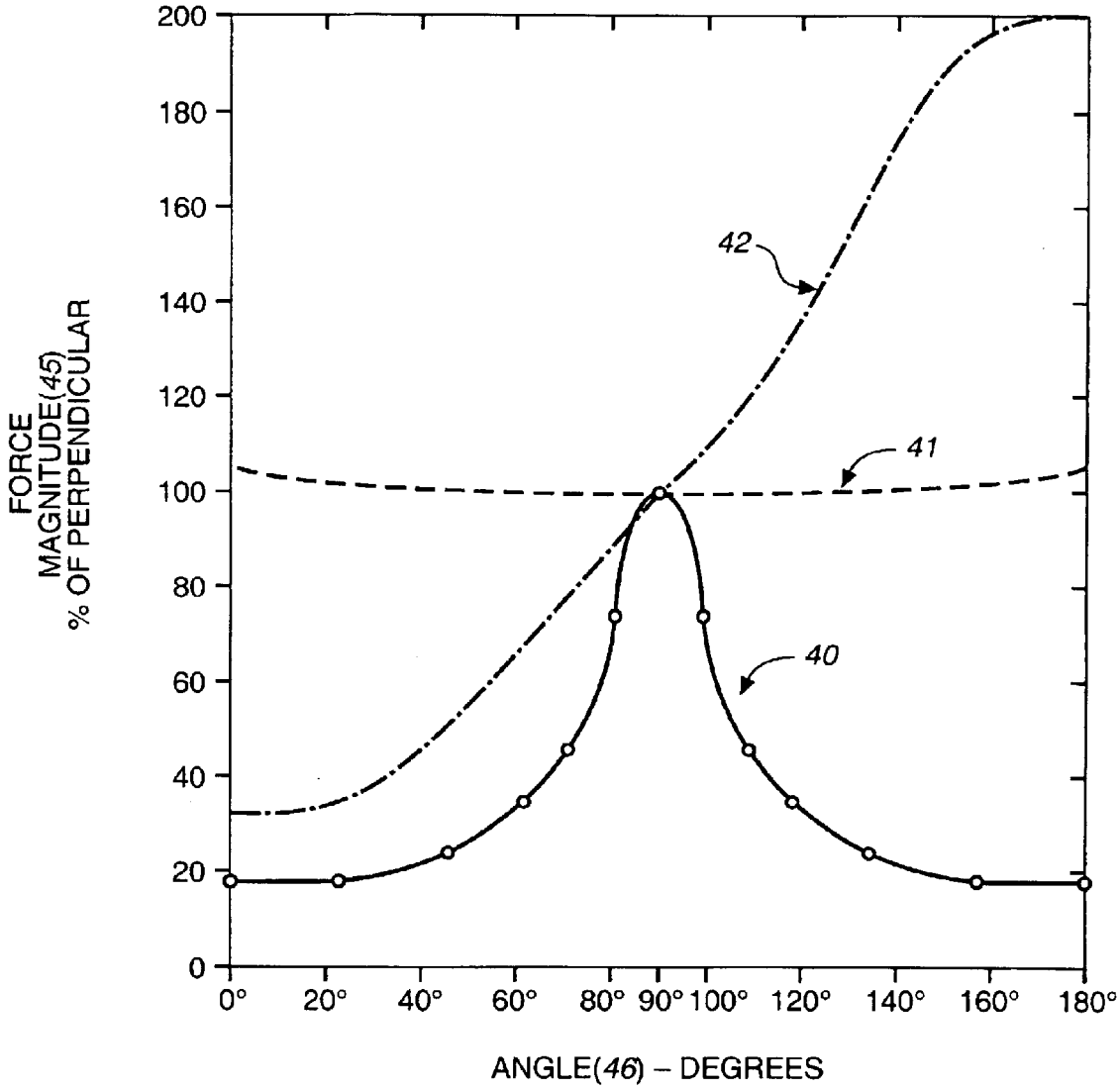
FIG. 7 is a graph of the release curves for several different types of magnetic couplers.

FIGS. 5, 6 and 7 all relate to experiments that demonstrate another unique characteristic of this invention compared to an ordinary magnetic coupling. FIG. 5 shows an ordinary disk magnet 47 which is magnetically attached to a flat piece of steel 48. The steel is attached to a support object 49. In the experiment, the disk magnet was 12 mm diameter, 2 mm thick and magnetized through the thickness of the magnet (the 2 mm dimension). This was a rare earth magnet that exhibits a substantial magnetic attraction force to a flat steel plate 48.

It is well known that permanent magnets, such as magnet 47, usually require much more force to detach from steel if the magnet is pulled perpendicular off the surface compared to pulling the magnet across the surface and eventually off the edge of the steel. The first experiment was designed to measure and graphically represent this characteristic. The experiment measured the force required to produce any motion of the magnet 47 relative to the steel 48. It did not matter whether the magnet was detached by a perpendicular force or merely slid across the surface by a non-perpendicular force.

To describe the results of this experiment, it is necessary to define the force vector used in the experiment. In FIG. 5, the force vector (represented by arrow 36) is applied to magnet 47. The force vector has an angle 46 and a scalar magnitude 45. In the experiment, a piece of string was attached to magnet 47. By pulling on the string at various angles relative to the flat surface of the steel 48, it was possible to measure the scalar magnitude of the force required to move the magnet.

The results of this experiment are plotted in FIG. 7. Line 40 in FIG. 7 is a graph of the force characteristics required to produce any motion of magnet 47 in FIG. 5. FIG. 7 plots the force magnitude 45 required to move the magnet versus the force angle 46. The term "force magnitude" will be used to designate the scalar part of the force vector. In FIG. 7, it can be seen that the greatest resistance to movement occurred when the force was perpendicular to the surface. FIG. 7 is a graph of the force magnitude 45 versus the force angle 46. The term "force magnitude" will be used to designate the scalar part of the force vector. The magnitude of the perpendicular force required for movement is defined as a magnitude of 100%. Graph line 40 shows a sharp decline in force magnitude required for movement when the force is applied at angles less than or more than 90 degrees. For example, applying the force parallel to the surface (0 degrees or 180 degrees) achieved a movement of the magnet at only 18% of the force magnitude required for a 90-degree movement. Actually, this 18% number relates to the coefficient of friction between the magnet and the steel surface.

Graph line 40 in FIG. 7 is similar to release curves of many prior art magnetic attachments between a permanent magnet and a piece of ferromagnetic material. Permanent magnets in the shape of a bar, disk, cube or horseshoe, all would have release curves generally similar to line 40. Even spherical magnets attached to a flat or curved (but not mating) ferromagnetic surface would have a similar release curve. This general release curve will be called "a release curve with a prominent maximum at 90 degrees". In contrast, it will be shown that the release curve of this invention can be tailored to be flat, or have a maximum at some other angle.

FIG. 6 is similar to FIG. 3, except that a force vector arrow 36 has been added. This force vector has an angle 46, relative to surface 27A (which is both a surface and the plane of the hole entrance). The force vector arrow also has a force magnitude of 45. It should be noted that in FIG. 6, the force is being applied to the ferromagnetic plate 23A and the spherical magnet 20 is fixed. Measurements were made of the force required to move plate 23A relative to magnet 20.

The results of this experiment are plotted as dashed line 41 in FIG. 7. It can be seen that the release characteristics of the spherical magnet and mating hole (depicted by curve 41) are dramatically different from the characteristics from an ordinary magnet attached to flat steel (depicted by curve 40). The relatively flat graph line 41 was obtained by using a hole diameter that was about 71% of the diameter of the spherical magnet. This is to say that in FIG. 2, hole 31A was about 71% of magnet diameter 29. This ratio produces approximately a uniform release force magnitude in all directions. If, for example, the hole diameter had been increased to 92% of the spherical magnet diameter, then the force magnitude required for release at 0° or 180° would have been approximately double the force required for a perpendicular release.

Therefore, one useful characteristic of this invention is that it is possible to achieve the same release magnitude at any angle. This can be very desirable for applications where safety requires a reliable release at a predetermined force magnitude, but independent of angle. A wide variety of release curves can be achieved by using other hole shapes. Graph line 42 in FIG. 7 will be discussed later.

Figure 8:
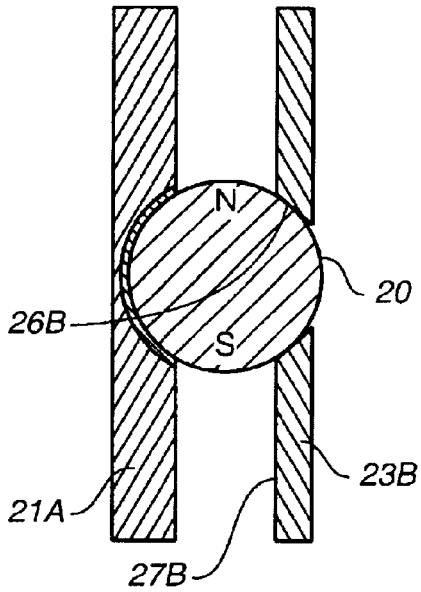
FIG. 8 is the preferred embodiment of the invention. It is a cross-sectional view similar to FIG. 3, except the hole has contoured sides.

FIG. 8 shows another variation on the design depicted in FIGS. 1, 2 and 3. In FIG. 8, the sides 26B are contoured to eliminate the sharp corner 28 contacting the spherical magnet 20 in FIG. 3. In FIG. 8, the cross sectioned side 26B is sloping. The actual shape of the hole side can either be a portion of a sphere or a portion of a cone. For example, a hole with a spherical sidewall is easy to obtain using a ball end mill with a diameter that matches the spherical magnet. A conical drill will give conical sides.

There are three benefits of using holes with contoured sides such as spherical or conical sides. These are: a) it is possible to achieve a stronger coupling between the magnet and the release member with contoured sides, b) contoured sides offer more possibilities for tailoring the shape of the release curve and c) contoured side eliminates the sharp edge of a straight hole and thus provide more accurate positioning of the spherical magnet. For example, a 90-degree conical drill produces a hole with conical sides which slope at a 45-degree angle relative to surface 27B. This conical hole can achieve an approximately flat release curve similar to line 41 in FIG. 7. A hole produced with a "ball end mill" has a side wall that mates perfectly with the spherical magnet if the ball end mill and the spherical magnet have the same diameter. The strongest magnetic coupling is achieved between the spherical magnet and a spherical hole. FIG. 8 can represent both a conical hole and a spherical hole because the difference between a cone and a sphere is not discernable on side 26B in FIG. 8.

It is difficult to designate a single variation of this invention as the preferred embodiment, because several slight variations produce useful embodiments that are optimum for different applications. However, the embodiment of FIG. 8, with a spherical sidewall 26B will be designated as the preferred embodiment of this invention.

Figure 9:
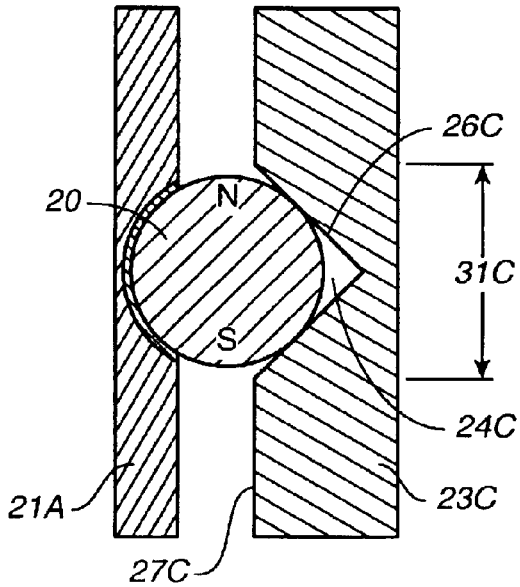
FIG. 9 is a cross sectional view similar to FIG. 3, except that the hole is a complete cone.

FIG. 9 is similar to FIG. 8, except that the thickness of member 23C has been increased and a full conical hole 26C is illustrated. In FIG. 9, the diameter of the conical hole at surface 27C is diameter 31C. The release curve of a conical hole depends on a) the angle of the cone, b) the entrance diameter of the hole, and c) the thickness of the ferromagnetic material. For example, a full 90-degree cone with an entrance diameter 1.5 times the spherical magnet diameter can also produce a generally flat release curve.

Figure 10:
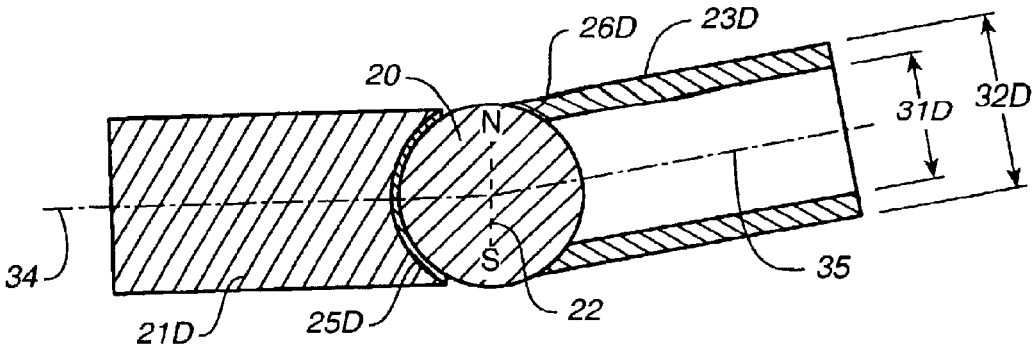
FIG. 10 is a cross sectional view where the release member is a tubular shape.

FIG. 10 is another variation of the invention. Here, magnet 20 is bonded by adhesive 25D to the cylindrical adhered member 21D. The magnet 20 is oriented such that its magnetic axis 22 is approximately perpendicular to the axis 34 of cylinder 21D. The release member 23D is illustrated as being a ferromagnetic cylindrical tube with an outer diameter of 32D, an inner diameter of 31D, and having an axis of 35. Detachable member 23D has an end surface 26D which is attracted to and contacts magnet 20. Surface 26D is illustrated as being a mating spherical surface to match spherical magnet 20, but this end could also be other shapes such as a conical or perpendicular cut surface.

FIG. 10 illustrates another useful characteristic of this invention. It can be seen that the axis 34 of the attached member 21B is not in alignment to axis 35 of ferromagnetic tubular member 23D. The spherical shape of magnet 20 gives this coupling device some of the characteristics of a ball joint.

Figure 11:
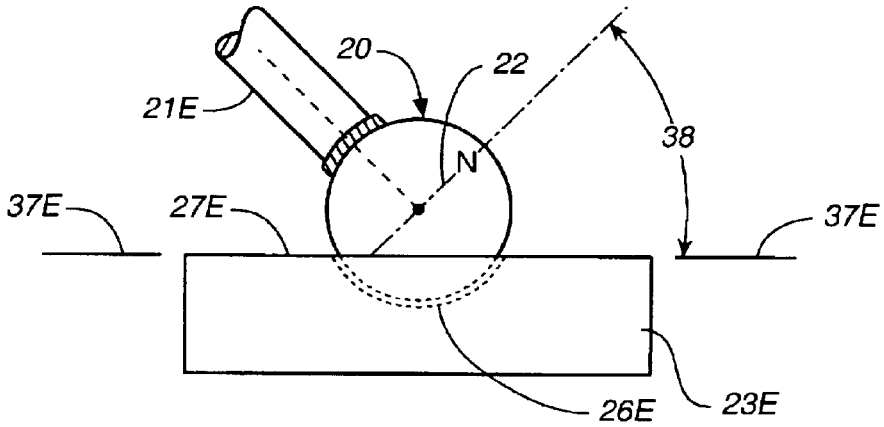
FIG. 11 is a side view which illustrates the angular adjustability of the magnetic coupler for rotation perpendicular to the magnetic axis.
Figure 12:
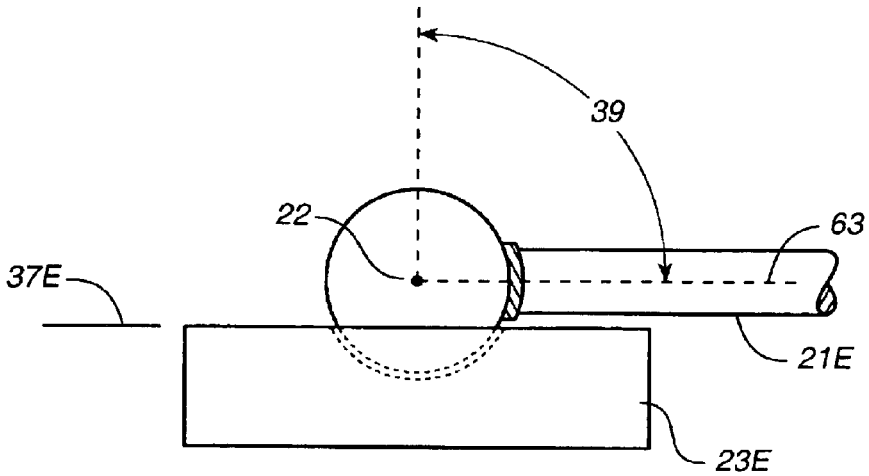
FIG. 12 is a side view which illustrates the angular adjustability of the magnetic coupler for rotation around the magnetic axis.

FIGS. 11 and 12 further illustrate the angular flexibility of this invention. FIG. 11 has a release member 23E with a hole that is a portion of a sphere. This will be referred to as a "spherical hole". The spherical hole approximately matches the radius of the spherical magnet. In FIG. 11, the spherical hole is hidden but the wall of the spherical hole is represented by dashed line 26E. In FIG. 11, the adhered member is shown as a cylinder 21E (preferably non-magnetic). In FIG. 11, lines 37E represents the plane of surface 27E. Plane 37E is also the plane of the entrance to the spherical hole with sidewall 26E. The plane 37E of the hole entrance will be used as a reference plane when discussing the angular tolerance of the spherical magnet coupling device. (In previous figures, any surface designated 27 can also be considered the plane of the entrance hole).

In FIG. 11, the magnetic axis 22 of the spherical magnet is shown tipped at angle 38 relative to the plane of the hole entrance 37E. In previous figures, the magnetic axis was usually illustrated as being parallel to the plane of the hole entrance. This parallel orientation gives the greatest coupling force, but it is also possible to tip the magnetic axis so that angle 38 reaches as much as plus or minus 45 degrees relative to plane 37E and still retain acceptable coupling force for many applications.

FIG. 12 is similar to FIG. 11, except that the position of the spherical magnet has been changed. In FIG. 12, the magnetic axis 22 is parallel to the plane 37E of the hole entrance, and we view the spherical magnet with the magnetic axis 22 pointing directly at us. The purpose of FIG. 12 is to discuss what happens when the magnet 20 is rotated around its magnetic axis. FIG. 12 is illustrated with the adhered member 21E parallel to the plane 37E of the entrance hole. For example, rotating the magnet around the magnetic axis 22 so that angle 39 equals 90 degrees would result in adhered member 21E being vertical. This axis of rotation produces no loss in magnetic coupling. Therefore, even a rotation of 180 degrees is possible without the loss of any magnetic coupling force.

Combining the two axes angular flexibility illustrated in FIGS. 11 and 12 shows the great flexibility of this magnetic coupler. One application would be to have adhered member 21E attach to an object which needs to be held at adjustable angles. In this case it would be desirable for there to be a predetermined amount of friction between the spherical magnet 20 and wall 26E to retain a desired angular position. In this case it is possible to increase the friction on the spherical magnet by using a spherical hole of slightly smaller radius than the radius of the spherical magnet. On the other hand, it may be desirable to decrease the friction. In this case it would be desirable to use a lubricant or coat either the spherical magnet or the hole surface with a low friction material. The spherical magnet could also be coated with chromium or other hard material to resist wear.

FIG. 12 can also be used to illustrate another one of the beneficial properties of this invention. Point 22 has previously been described as the magnetic axis viewed from the end. However, now consider point 22 in FIG. 12 to also represent the geometric center of the sphere. The spherical hole 24E also has a center of curvature and this center will also be located at point 22 if the radius of the spherical hole matches the spherical magnet radius. The male and female spherical components will mate exactly and the magnetic attraction force holds these two components in exact relationship while providing the angular flexibility previously discussed. This is a very useful property that can be used in machining and other applications requiring exact location of a point in X, Y and Z but independent of angle. This exact positioning property also applies to conical holes or even straight edge holes.

Up until now, all the illustrations had a circular symmetric hole in the release member. The previous holes such as hole 24A in FIG. 1 or hole 24C in FIG. 9 differed in the shape of the sidewalls but they all were symmetric about an axis. Such holes have a release curve that is also symmetrical about the axis of symmetry for the hole.

Sometimes it is desirable to have an unsymmetrical release curve. For example, some applications require that a coupler release relatively easily when a force is applied in a particular direction compared to the force required to cause release if the force is applied in other directions.

Figure 13:
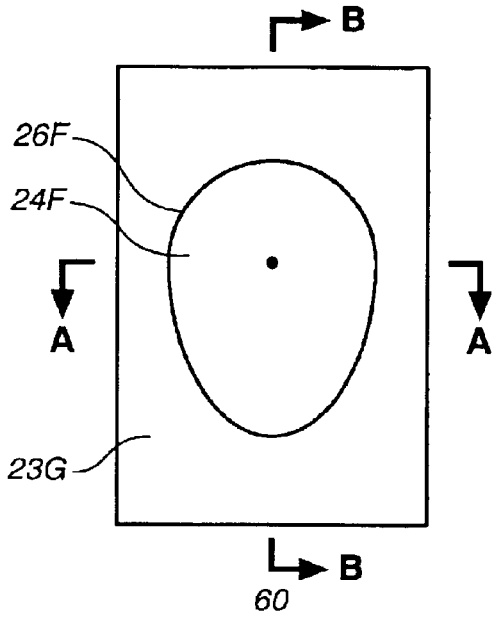
FIG. 13 is a top view of a release member with an unsymmetrical hole.
Figure 15:
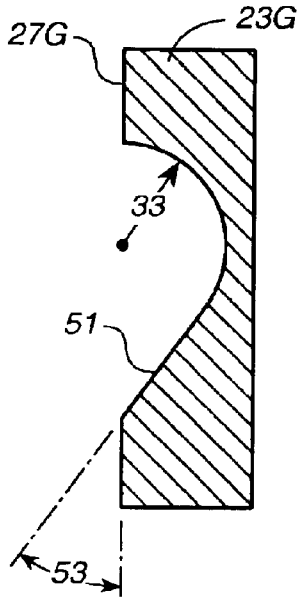
FIG. 15 is a cross sectional view of the release member in FIG. 13 cut through line B—B.
Figure 14:
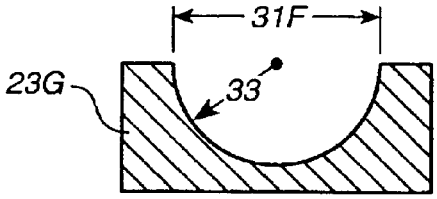
FIG. 14 is a cross sectional view of the release member in FIG. 13 cut through line A—A.

FIGS. 13, 14 and 15 show a release member which has an unsymmetrical hole and an unsymmetrical release curve. FIG. 13 shows a front view of a release member 23G with an unsymmetrical hole 24F with an edge 26F. FIG. 14 shows a cross sectional view cut along line A—A in FIG. 13. FIG. 14 also shows the hole width dimension 31F. This dimension is significant because, preferably, dimension 31F should be between 0.6 and 1.5 times the diameter of the spherical magnet. FIG. 15 shows another cross section of release member 23G cut along line B—B.

The hole illustrated in FIGS. 13, 14 and 15 can be made using a ball end mill. In FIG. 15, it can be seen that one part of the hole cross section has a straight side 51 which makes an angle 53 with the surface 27G (which is also the plane of the hole entrance as previously defined in FIG. 11).

There are two ways to make the hole 24F depicted in FIGS. 13, 14 and 25. One way is to simultaneously translate and penetrate a ball end mill into the release member 23G. The angle 53 is determined by the relative feed rate of translation versus penetration. Once the ball end mill has reached a predetermined depth, it is withdrawn from the hole without doing any further cutting. The portion of the hole that lies above line A—A in FIG. 13 is a portion of a sphere with a radius 33 as shown in FIGS. 14 and 15. The radius 33 was obtained because this was the radius of the ball end mill used to make the hole. The portion of the hole below line A—A is unsymmetrical relative to a sphere.

The second way to produce the hole depicted in FIGS. 13, 14, and 15 is to use a ball end mill like an ordinary drill to drill a hole at angle 53 into the surface 27G. The penetration is stopped when the desired hole shape is reached.

Figure 16:
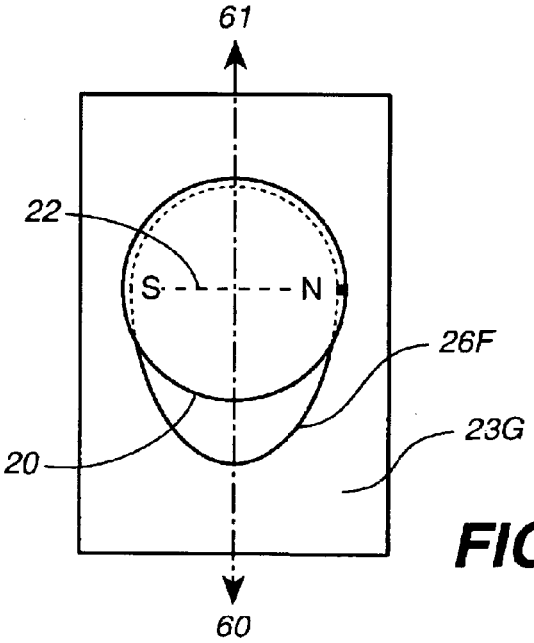
FIG. 16 is a top view of the release member in FIG. 13, but with the addition of a spherical magnet.

FIG. 16 is a view similar to FIG. 13, except that the spherical magnet 20 is shown placed in the hole. In FIG. 16, the hole edge, 26F, can be seen protruding beyond the spherical magnet 20. The hole is elongated in the direction of 60 in FIG. 16. Also, the preferred orientation of the magnetic axis 22 is shown as being perpendicular to line 60–61.

In the circular symmetric holes discussed prior to FIG. 13, the magnetic axis orientation did not matter as long as it was very roughly in the hole entrance plane (plane 37E in FIG. 11). However, the unsymmetrical hole has an elongation in the direction of 60 and there is a preferred magnetic axis orientation generally parallel to line A—A. Misalignment of this orientation will have a similar effect to the magnetic axis misalignment previously discussed in FIG. 11. A misalignment of the magnetic axis relative to the unsymmetrical hole geometry will result in a loss of magnetic coupling strength, but it can be tolerated up to an experimentally determined limiting angle.

The purpose of making this unsymmetrical hole is to create a release curve that has a relatively easy release direction. In FIG. 16, moving the magnet in the direction 60 will release the magnet easier than any other direction, including pulling the magnet perpendicular to surface 27G. There are many applications where it is desirable to have a coupler that releases easily when a force is applied from one direction, but resists removal when a force is applied from any other direction.

Curve 42 in FIG. 7 shows the approximate release curve for forces applied to the magnet 20 to cause release from release member 23G, depicted in FIG. 16. Taking FIGS. 7 and 16 together, direction 60 in FIG. 16 is considered 0 degrees in FIG. 7. Similarly, direction 61 is considered 180 degrees in FIG. 7. Applying a force to magnet 20 at 90 degrees would be a force out of the plane of the paper of FIG. 16 (perpendicular to surface 27G in FIG. 15). The magnitude of the perpendicular release force is set as 100% and other forces required for release are relative.

From FIG. 7, it can be seen that applying a force to the magnet at 0 degrees can result in a release less than one third the force required for a perpendicular release. Applying the force at 180 degrees (direction 61 in FIG. 16) has a force magnitude that is shown as 200% of the perpendicular release force. However, this 200% number is just used for illustration. The exact value depends on the depth and shape of the hole 24F in FIG. 13. It can be stated that with an optimized hole shape, it should be possible to achieve a release force at 180 degrees that is at least 10 times greater than the release force required at 0 degrees.

The example above was an unsymmetrical hole made using ball end mill. It should be understood that other unsymmetrical hole shapes could also be used. In fact, one of the advantages of this invention is that it is possible to achieve other release curves using other unsymmetrical hole shapes and contours. For example, an elliptical hole could have two directions of low release force.

Figure 17:
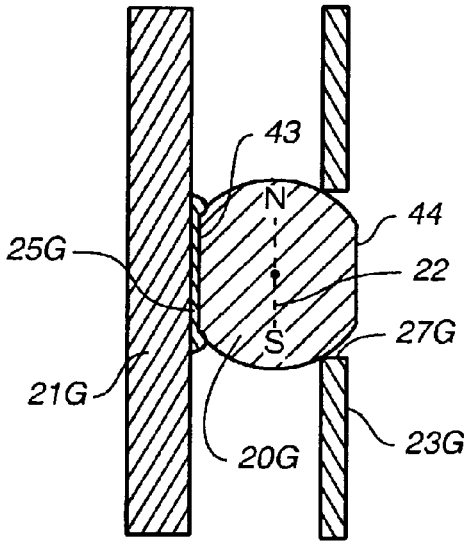
FIG. 17 is a cross sectional view similar to FIG. 3, except it shows an example of a "substantially spherical magnet".

Thus far, all the examples have been given using perfectly spherical magnets. It should be understood that all that is really required is a magnet that is "generally spherical". FIG. 17 depicts an example of a magnet 20G that is considered "generally spherical" without being perfectly spherical. This particular magnet is shown with two flattened areas 44 and 43. Having these areas flattened does not substantially change the operation of the magnetic coupler. In FIG. 17, flat area 43 is adhered to nonmagnetic adhered member 21G by adhesive 25G. Also, release member 23G has a hole that contacts a portion of the magnet 20G along a contact region, 27G in FIG. 17.

The point of this is that the flat areas 22 and 23 on the magnet do not substantially effect the functioning of the magnetic coupler and the teachings herein still apply. Other variations from a perfect sphere are also possible without departing from these teachings.

Figure 18:
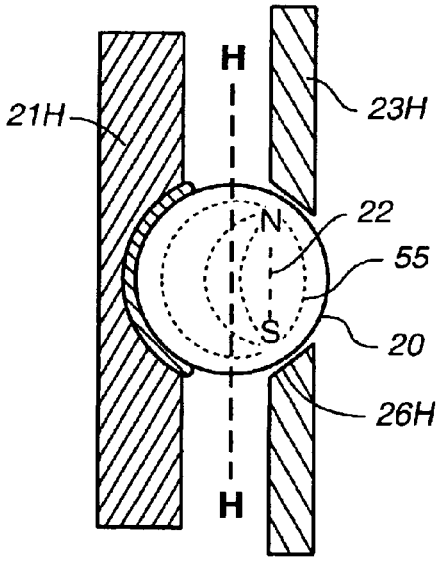
FIG. 18 is a cross sectional view similar to FIG. 8, except that the spherical magnet has been magnetized so that both magnetic poles are in the same hemisphere.

FIG. 18 is similar to FIG. 8, except in FIG. 18 the magnet's magnetic North and South poles have been displaced so that they are less than 180 degrees apart on the spherical magnet. FIG. 18 also shows that the magnetic axis 22 is displaced to one side and therefore does not pass through the center of the sphere as it did in all previous figures. FIG. 18 also shows the internal magnetic flux lines 55.

When the North and South magnetic poles are 180 degrees apart, as in previous figures, then the internal flux lines would normally be symmetrical around the magnetic axis. Also, if the internal flux lines were uniform and parallel, then it would be impossible to displace the magnetic poles from being 180 degrees apart. However, magnetizing the magnet so that it has a focused magnetic field also makes it possible to displace the North and South magnetic poles so that they both are positioned within a single hemisphere of the spherical magnet. Imaginary line H—H in FIG. 18, defines the edge of a hemisphere in the spherical magnet which symmetrically contains both magnetic poles.

The advantage of placing both magnetic poles inside a single hemisphere is that it is then possible to attach the magnet 20 to the adhered member 21H in such a way that the hemisphere containing both magnetic poles contacts the release member 23H when there is magnetic coupling. This orientation is depicted in FIG. 18. The advantage of the magnetic coupling depicted in FIG. 18 is that it will be stronger than the magnetic coupling depicted in FIG. 8.

It was earlier mentioned that only a part of the release member had to be ferromagnetic, but all the subsequent text, for simplicity, presumed that the release member was completely ferromagnetic. Only a portion of the area near the hole 24 needs to be ferromagnetic. The objective is to provide a magnetic circuit for magnetic flux lines such that there is a substantial magnetic attraction between the spherical magnet 20 and at least some ferromagnetic material near hole 24. If the release member is not completely ferromagnetic, then it is possible to experimentally determine the amount of ferromagnetic material required to obtain the desired magnetic attraction to the spherical magnet.

Similarly, it was said earlier that adhered member 21A preferably should be non-magnetic. This is not a requirement because even if the part of the adhered member nearest the spherical magnet 20 is ferromagnetic, this will just reduce the magnetic coupling force without destroying the properties described here.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed is:

1. A magnetic coupling apparatus comprising:

a generally spherical magnet;

an adhered member connected to said spherical magnet; and a release member bearing a hole, wherein when said spherical magnet is at least partially inserted into said hole, said adhered member is magnetically coupled to said release member.

2. The magnetic coupling apparatus of claim 1 wherein said spherical magnet is a rare earth magnet.

3. The magnetic coupling apparatus of claim 1 wherein said spherical magnet has a focused magnetic field.

4. The magnetic coupling apparatus of claim 1 wherein said spherical magnet has a magnetic axis, said hole defines a plane, and said magnetic axis is oriented generally parallel to said plane.

5. The magnetic coupling apparatus of claim 1 wherein said generally spherical magnet includes at least one flat portion.

6. The magnetic coupling apparatus of claim 1 wherein said spherical magnet has a diameter, said hole has a width dimension, and said hole width dimension is between 60% and 150% of said spherical magnet diameter.

7. The magnetic coupling apparatus of claim 1 wherein said adhered member is non-magnetic.

8. The magnetic coupling apparatus of claim 1 wherein said adhered member is connected to said spherical magnet by adhesive.

9. The magnetic coupling apparatus of claim 1 wherein said release member has a surface, and said hole has sides perpendicular to said surface.

10. The magnetic coupling apparatus of claim 1 wherein said hole has conical sides.

11. The magnetic coupling apparatus of claim 1 wherein said hole has sides which are a portion of a sphere.

12. The magnetic coupling apparatus of claim 1 wherein said hole is unsymmetrical.

13. The magnetic coupling apparatus of claim 1 wherein said spherical magnet has two magnetic poles which are not on opposite sides of said spherical magnet.

14. A method for magnetically coupling an adhered member to a release member, said method comprising the steps of:

connecting a generally spherical magnet to the adhered member;

providing a hole in the release member; and inserting the spherical magnet into the hole so that the adhered member is magnetically coupled to the release member.

15. The method for magnetically coupling an adhered member to a release member of claim 14 further including the step of:

orienting the magnetic axis of the spherical magnet generally parallel to the plane of the hole.

16. The method for magnetically coupling an adhered member to a release member of claim 14 further including the step of:

providing the hole with a width dimension of between 60% and 150% of the spherical magnet diameter.

17. The method for magnetically coupling an adhered member to a release member of claim 14 further including the step of:

providing the hole with conical sides.

18. The method for magnetically coupling an adhered member to a release member of claim 14 further including the step of:

providing the hole with sides which are a portion of a sphere.

19. A magnetic coupling device comprising:

a generally spherical magnet;

an adhered member attached to said spherical magnet; and a release member with a hole of a predetermined size and shape suitable to mate with said spherical magnet, wherein said release member including at least some ferromagnetic material adjacent said hole such that when said spherical magnet enters said hole, said adhered member is connected to said release member by a magnetic coupling which exhibits angular flexibility.

20. The magnetic coupling apparatus of claim 19 where said spherical magnet has a north pole and a south pole which are not on opposite sides of said spherical magnet.

21. A magnetic coupling device comprising:

a generally spherical magnet;

an adhered member attached to said spherical magnet; and a release member bearing a hole, said hole having a predetermined size and shape suitable to mate with said spherical magnet, wherein when said spherical magnet enters said hole, a magnetic attachment is formed which exhibits a predetermined release curve that depends on the size and shape of said hole.

22. A magnetic coupling device comprising:

a generally spherical magnet exhibiting a geometric center;

an adhered member attached to said spherical magnet; and a release member containing a hole of a predetermined size and shape suitable to mate with said spherical magnet, said release member including at least some ferromagnetic material adjacent said hole such that when said spherical magnet enters said hole, a magnetic attachment is formed which positions the geometric center of said spherical magnet at a predetermined point relative to said hole.

23. A magnetic coupling device comprising:

an adhered member attached to a spherical magnet, said spherical magnet having a predetermined diameter D and a magnetic axis; and a release member bearing a hole in a piece of ferromagnetic material, said hole having a diameter larger than D but less than 1.5 D, wherein said spherical magnet is oriented such that when said spherical magnet enters said hole, said spherical magnet seeks a magnetic equilibrium position within said hole and thereby elastically couples said adhered member to said release member.

* * * * *